US009076382B2

(12) United States Patent
Choi

(10) Patent No.: US 9,076,382 B2
(45) Date of Patent: Jul. 7, 2015

(54) PIXEL, ORGANIC LIGHT EMITTING DISPLAY DEVICE HAVING DATA SIGNAL AND RESET VOLTAGE SUPPLIED THROUGH DEMULTIPLEXER, AND DRIVING METHOD THEREOF

(75) Inventor: Sang Moo Choi, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1061 days.

(21) Appl. No.: 11/655,400

(22) Filed: Jan. 19, 2007

(65) Prior Publication Data

US 2007/0242016 A1 Oct. 18, 2007

(30) Foreign Application Priority Data

Apr. 17, 2006 (KR) ..... 10-2006-0034616

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0861* (2013.01); *G09G 2300/0465* (2013.01); *G09G 2320/043* (2013.01); *G09G 2310/0251* (2013.01); *G09G 2300/0842* (2013.01); *G09G 2310/0297* (2013.01)

(58) Field of Classification Search
CPC ..... G09G 3/3291; G09G 2310/0297
USPC ..... 345/92, 76–82; 313/169.3
See application file for complete search history.

(56) References Cited

U.S. PATENT DOCUMENTS

| | | | | |
|---|---|---|---|---|
| 6,229,506 | B1 | 5/2001 | Dawson et al. | |
| 6,373,454 | B1 | 4/2002 | Knapp et al. | |
| 2002/0044109 | A1 | 4/2002 | Kimura | |
| 2004/0246241 | A1 | 12/2004 | Sato et al. | |
| 2004/0252089 | A1 | 12/2004 | Ono et al. | |
| 2005/0237281 | A1 | 10/2005 | Tam | |
| 2006/0044233 | A1 * | 3/2006 | Lee et al. | 345/76 |

(Continued)

FOREIGN PATENT DOCUMENTS

| | | |
|---|---|---|
| CN | 1360295 A | 7/2002 |
| CN | 1565013 | 1/2005 |

(Continued)

OTHER PUBLICATIONS

Patent Abstracts of Japan, Publication No. 2002-287697; Publication Date: Oct. 4, 2002; in the name of Sato et al.

(Continued)

*Primary Examiner* — Dennis Joseph
(74) *Attorney, Agent, or Firm* — Christie, Parker & Hale LLP

(57) ABSTRACT

A method for driving an organic light emitting display device capable of reducing the number of output lines in a data driver, as well as ensuring a sufficient driving time. The method for driving the organic light emitting display device includes steps of supplying a data signal and a reset voltage to an output line during a horizontal period; supplying the data signal and the reset voltage, supplied to the output line, to a plurality of data lines using a demultiplexer; charging a voltage corresponding to the data signal in a pixel connected with one of the data lines during a period when a scan signal is supplied to a current scan line of the pixel; and allowing the pixel to emit light corresponding to the charged voltage.

15 Claims, 9 Drawing Sheets

(56) References Cited

U.S. PATENT DOCUMENTS

| | | | | |
|---|---|---|---|---|
| 2006/0071884 | A1 | 4/2006 | Kim | |
| 2006/0107143 | A1 | 5/2006 | Kim et al. | |
| 2006/0208974 | A1 * | 9/2006 | Hara | 345/76 |

FOREIGN PATENT DOCUMENTS

| | | | |
|---|---|---|---|
| CN | 1734540 | | 2/2006 |
| EP | 1 372 136 | A1 | 12/2003 |
| EP | 1 635 324 | A1 | 3/2006 |
| EP | 1 755 104 | A2 | 2/2007 |
| JP | 61-223791 | | 10/1986 |
| JP | 11-327518 | | 11/1999 |
| JP | 11-338438 | | 12/1999 |
| JP | 2001-249650 | | 9/2001 |
| JP | 2002-287697 | | 10/2002 |
| JP | 2003-140626 | | 5/2003 |
| JP | 2003-186437 | | 7/2003 |
| JP | 2005-031630 | | 2/2005 |
| JP | 2005-91724 | | 4/2005 |
| JP | 2005-300897 | | 10/2005 |
| JP | 2005-326793 | | 11/2005 |
| JP | 2005-331900 | | 12/2005 |
| JP | 2006-065282 | | 3/2006 |
| JP | 2006-065286 | | 3/2006 |
| JP | 2006-065328 | | 3/2006 |
| KR | 1999-024841 | | 4/1999 |
| KR | 2000-0074551 | | 12/2000 |
| KR | 10-2005-0113706 | | 12/2005 |
| KR | 10-2006-0018766 | | 3/2006 |
| KR | 10-2006-0032829 | A | 4/2006 |

OTHER PUBLICATIONS

Patent Abstracts of Japan, Publication No. 2003-186437; Publication Date: Jul. 4, 2003; in the name of Yamada.

Patent Abstracts of Japan, Publication No. 2005-091724; Publication Date: Apr. 7, 2005; in the name of Ozawa et al.

Korean Patent Abstracts, Publication No. 1020050113706 A; Publication Date: Dec. 5, 2005; in the name of Jung.

Korean patent abstract for Korean application No. 10 1997-046213 corresponding to Korean publication No. 1999-024841 listed above.

Korean patent abstract for publication No. 1020000074551 A, dated Dec. 15, 2000 in the name of Yong Min Ha, et al.

Extended European Search Report dated Feb. 27, 2009, in corresponding European Patent Application No. 07251442.5, listing the cited references in this IDS.

Korean Patent Abstracts, Publication No. 1020060018766 A; Publication Date: Mar. 2, 2006; in the name of Yang Wan Kim et al.

Office Action dated Apr. 30, 2007 for corresponding Korean Patent Application No. 10-2006-0034616.

SIPO Office Action dated Sep. 26, 2008, for corresponding China Patent Application No. 200710097106.8, with English translation indicating relevance of references listed in this IDS.

Japanese Office action dated Mar. 30, 2010, for corresponding Japanese Patent application 2006-229284, noting listed references in this IDS.

English translation (Detailed Description and Claim 1), corresponding to Japanese Publication No. 61-223791 listed above.

Japanese Office action dated Dec. 8, 2009, for corresponding Japanese application 2006-229284, noting listed references in this IDS.

European Search Report dated Jul. 13, 2010, for corresponding European Patent application 07251442.5, noting listed reference in this IDS, as well as references filed in an IDS dated Mar. 26, 2009.

European Summons to Attend Oral Proceedings, dated Dec. 22, 2011, for corresponding European Patent application 07251442.5, 14 pages.

Choi, S.M, et al., *A Self-compensated Voltage Programming Pixel Structure for Active-Matrix Organic Light Emitting Diodes*, IDW Proceedings of the International Display Workshops, XX, XX, Jan. 1, 2003, pp. 535-538. XP 008057381.

European Summons to Attend dated Dec. 10, 2012, for corresponding European Patent application 07251442.5, (15 pages).

Japanese Office action dated Sep. 3, 2013, for corresponding Japanese Patent application 2006-229284, (2 pages).

Korean Notice of Allowance dated Oct. 31, 2007 for Korean Patent Application No. 10-2006-0034616, 1 page.

Chinese Patent Gazette dated Aug. 5, 2009 for Chinese Patent Application No. 2007/10097106.8 which claims priority of the corresponding Korean priority application No. 10-2006-0034616, 1 page.

* cited by examiner

PIXEL, ORGANIC LIGHT EMITTING DISPLAY DEVICE HAVING DATA SIGNAL AND RESET VOLTAGE SUPPLIED THROUGH DEMULTIPLEXER, AND DRIVING METHOD THEREOF

CROSS-REFERENCE TO RELATED APPLICATION

This application claims priority to and the benefit of Korean Patent Application No. 10-2006-0034616, filed on Apr. 17, 2006, in the Korean Intellectual Property Office, the entire content of which is incorporated herein by reference.

BACKGROUND

1. Field of the Invention

The present invention relates to an organic light emitting display and a driving method thereof, and more specifically, to a pixel of an organic light emitting display device and a driving method thereof.

2. Discussion of Related Art

An organic light emitting display device is a flat panel display device that displays an image using an organic light emitting diode which generates lights by recombination of electrons and holes. Such an organic light emitting display device has a rapid response time and may be driven with a low power consumption. A conventional organic light emitting display device allows an organic light emitting diode to emit lights by supplying an electric current, corresponding to data signals, to the organic light emitting diode using a drive transistor formed in every pixel.

FIG. 1 is a schematic view showing a conventional organic light emitting display device.

Referring to FIG. 1, the conventional organic light emitting display device includes a pixel unit (or display region) 30 including pixels 40 formed at cross regions of scan lines (S1 to Sn) and data lines (D1 to Dm); a scan driver 10 for driving the scan lines (S1 to Sn) and emission control lines (E1 to En); a data driver 20 for driving the data lines (D1 to Dm); and a timing controller 50 for controlling the scan driver 10 and the data driver 20.

The scan driver 10 generates scan signals in response to scan driving control signals (SCS) supplied from the timing controller 50, and sequentially supplies the generated scan signals to the scan lines (S1 to Sn). Also, the scan driver 10 generates emission control signals in response to the scan driving control signals (SCS), and sequentially supplies the generated emission control signals to the emission control lines (E1 to En).

The data driver 20 generates data signals in response to the data driving control signals (DCS) supplied from the timing controller 50, and supplies the generated data signals to the data lines (D1 to Dm). Here, the data driver 20 supplies data signals, corresponding to one line, to the data lines (D1 to Dm) during every horizontal period (1H).

The timing controller 50 generates data driving control signals (DCS) and scan driving control signals (SCS) to correspond to synchronizing signals supplied from an external source. The data driving control signals (DCS) generated in the timing controller 50 are supplied to the data driver 20, and the scan driving control signals (SCS) are supplied to the scan driver 10. Also, the timing controller 50 rearranges data supplied from an external source, and then supplies the rearranged data to the data driver 20.

The pixel unit (or display region) 30 receives a first power of a first power supply (ELVDD) and a second power of a second power supply (ELVSS) externally, and supplies the first power of the first power supply (ELVDD) and the second power of the second power supply (ELVSS) to each of the pixels 40. The pixels 40 receiving the first power of the first power supply (ELVDD) and the second power of the second power supply (ELVSS) control a current capacity to correspond to the data signals (i.e., the current capacity that flows from the first power supply (ELVDD) to the second power supply (ELVSS) via the organic light emitting diode (OLED)). In this case, an emission time of the pixels 40 is controlled to correspond to the emission control signals.

In the conventional organic light emitting display device driven in the manner as described above, the pixels 40 are arranged at crossings of the scan lines (S1 to Sn) and the data lines (D1 to Dm). Here, the data driver 20 includes the number m of output lines so that the data driver 20 can supply the data signals to the number m of the data lines (D1 to Dm), respectively. That is, the data driver 20 includes the same number of the output lines as that of the data lines (D1 to Dm) in the conventional organic light emitting display device. For this purpose, the data driver 20 includes a relatively large number of data driving circuits to drive the output lines, and therefore the manufacturing cost is increased. In particular, as resolution and size of the pixel unit 30 increase, the number of the output lines of the data driver 20 also increases to thereby increase the manufacturing cost of the pixel unit 30.

SUMMARY OF THE INVENTION

Accordingly, an aspect of the present invention provides a pixel capable of reducing the number of output lines in a data driver while ensuring a sufficient driving time, an organic light emitting display device using the same, and a driving method thereof.

A first embodiment of the present invention provides a method for driving an organic light emitting display device, including steps of supplying a data signal and a reset voltage to an output line during a horizontal period; supplying the data signal and the reset voltage, supplied to the output line, to a plurality of data lines using a demultiplexer; charging a voltage corresponding to the data signal in a pixel connected with one of the data lines during a period when a scan signal is supplied to a current scan line of the pixel; and allowing the pixel to emit light corresponding to the charged voltage.

A second embodiment of the present invention provides an organic light emitting display device including a data driver for supplying a data signal and a reset voltage to an output line during every horizontal period; a demultiplexer coupled to the output line to supply the data signal and the reset voltage to a plurality of data lines; a scan driver for supplying a scan signal during every horizontal period; and a pixel connected with one of the data lines, a previous scan line, and a current scan line, wherein the pixel is reset by the reset voltage during a period when the scan signal is supplied to the previous scan line, and is charged with a voltage corresponding to the data signal when the scan signal is supplied to the current scan line.

A third embodiment of the present invention provides a pixel including an organic light emitting diode; a storage capacitor for charging a voltage corresponding to a data signal supplied to one of a plurality of data lines; a first transistor for supplying an electric current, corresponding to a voltage charged in the storage capacitor, to the organic light emitting diode; a second transistor connected to the one of the data lines, a current scan line, and a second electrode of the first transistor, the second transistor being adapted to turn on when a scan signal is supplied to the current scan line; a third transistor connected between a first electrode and a gate electrode of the first transistor and being adapted to turn on when the scan signal is supplied to the current scan line; and a fourth transistor connected between the gate electrode of the first transistor and the one of the data line and being adapted to turn on when the scan signal is supplied to a previous scan line.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
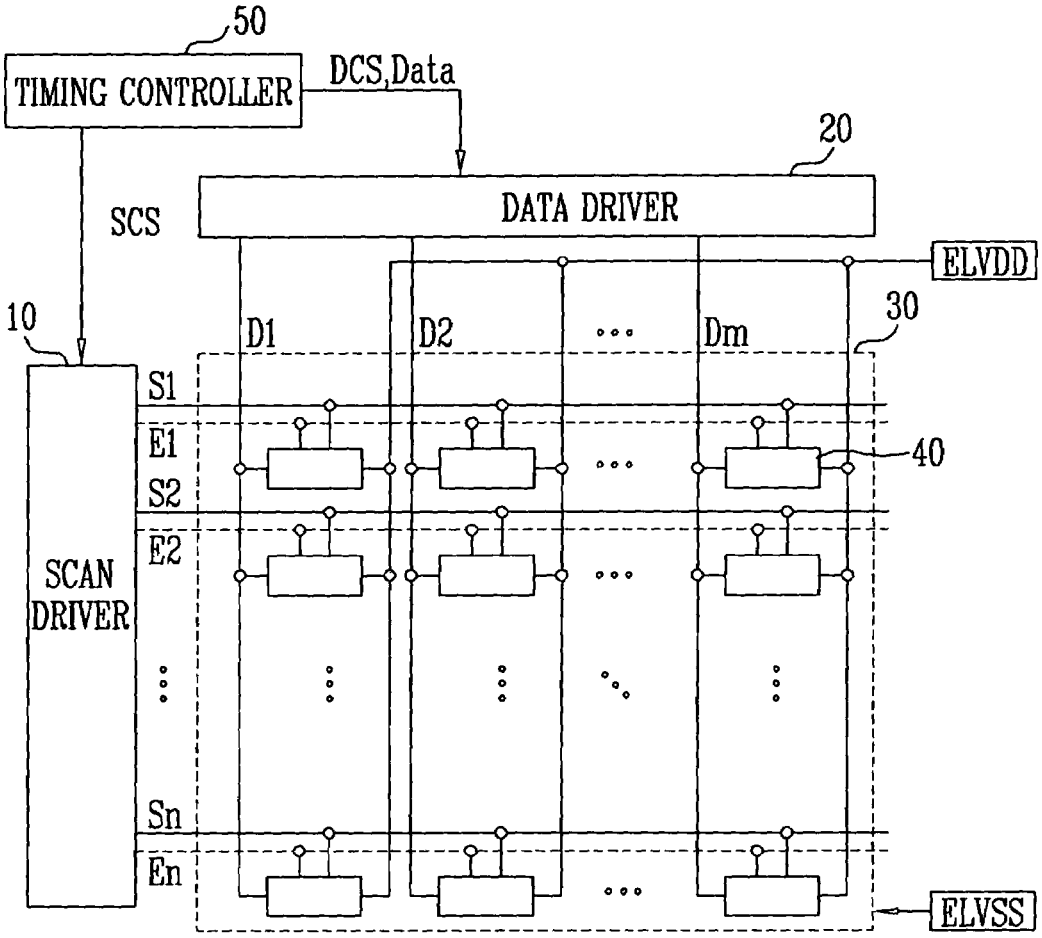
FIG. 1 (PRIOR ART)
FIG. 1 is a schematic view showing a conventional organic light emitting display device.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

Figure 2:
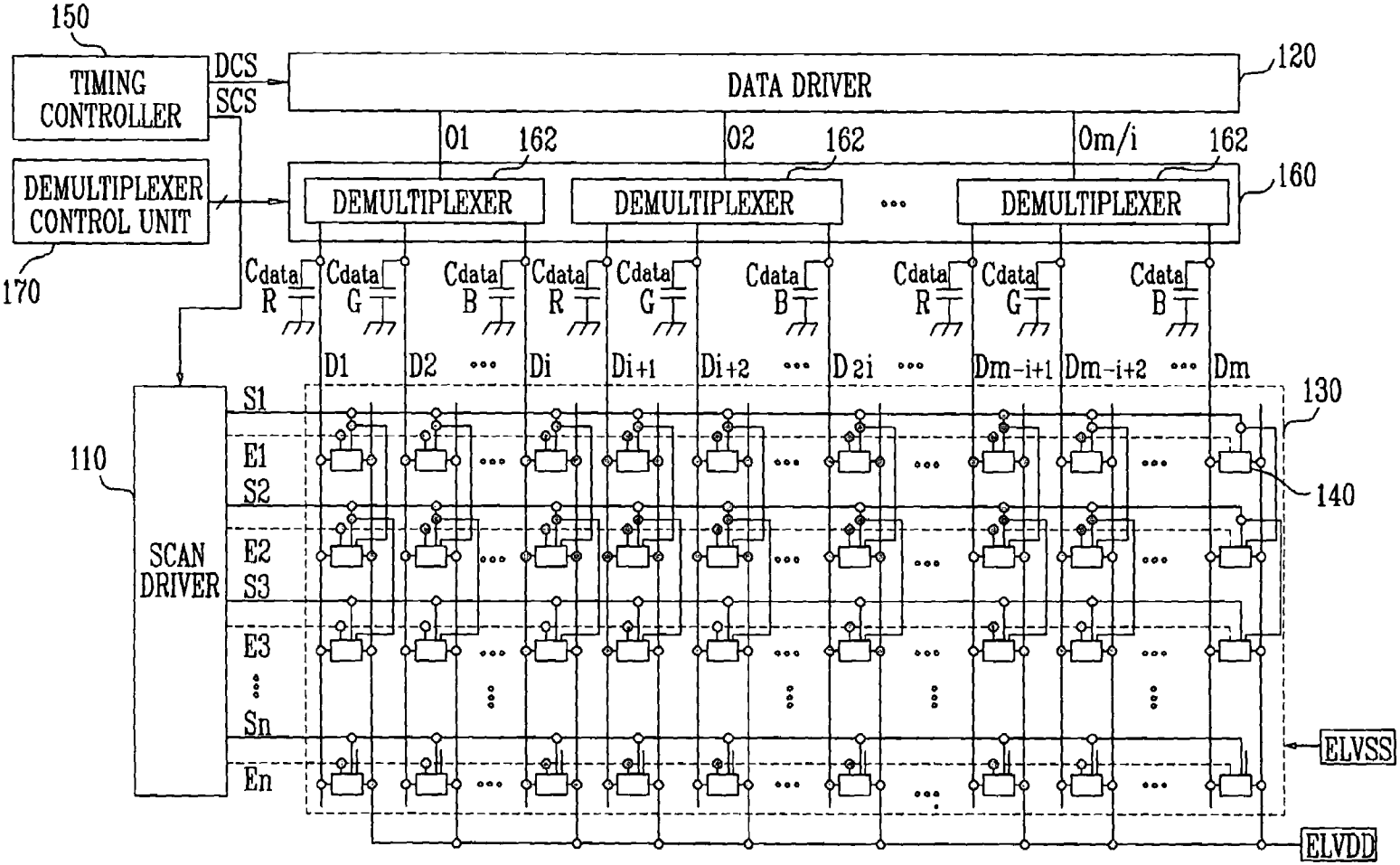
FIG. 2 is a schematic view showing an organic light emitting display device according to one embodiment of the present invention.

FIG. 2 is a schematic view showing an organic light emitting display device according to one embodiment of the present invention.

Referring to FIG. 2, the organic light emitting display device includes a scan driver 110, a data driver 120, a pixel unit (or display region) 130, a timing controller 150, a demultiplexer block unit 160, a demultiplexer control unit 170, and data capacitors (Cdata).

The pixel unit (or display region) 130 includes a plurality of pixels 140 arranged in a region defined by the scan lines (S1 to Sn) and the data lines (D1 to Dm). Each of the pixels 140 is allowed to emit lights having a luminance (e.g., a predetermined luminance) corresponding to data signals supplied from the data lines (D). For this purpose, each of the pixels 140 is connected to two scan lines, one data line, a power line (not shown) for supplying a first power of a first power supply (ELVDD), and a reset power line (not shown) for supplying a reset power of a reset power supply. For example, each of the pixels 140 positioned in the last horizontal line is connected to an n−1$^{st}$ scan line (Sn−1), an n$^{th}$ scan line (Sn), a data line (D), a power line, and a reset power line. Also, the pixel unit further includes a scan line (for example, a 0$^{th}$ scan line (S0)) so that the 0$^{th}$ scan line can be connected to the pixels 140 positioned in the first horizontal line.

Figure 4:
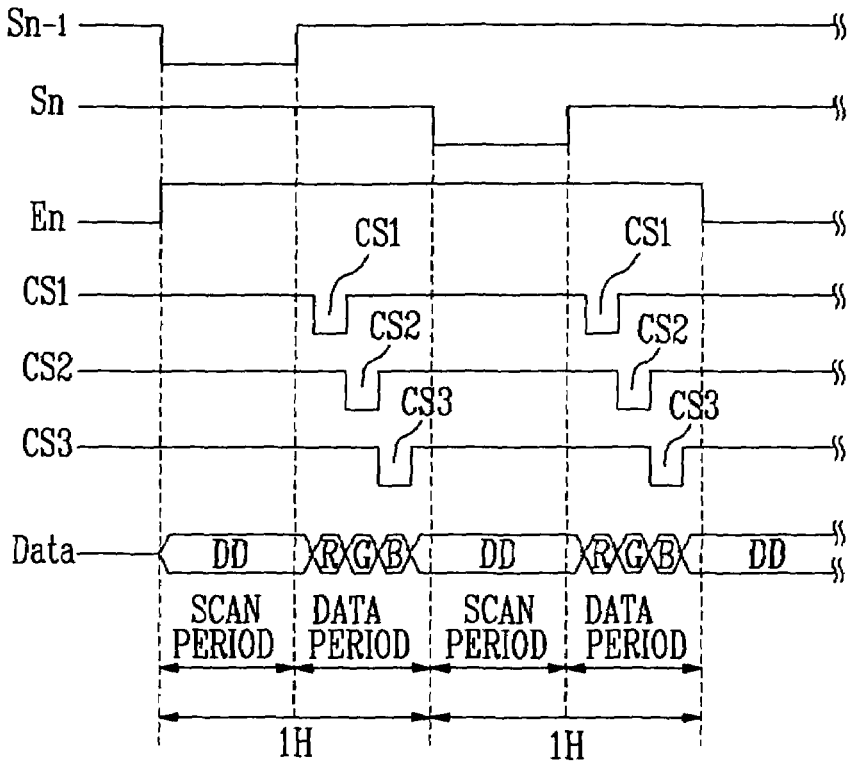
FIG. 4 is a waveform view showing a method for driving an organic light emitting display device according to a first embodiment of the present invention.

The scan driver 110 generates scan signals in response to the scan driving control signal (SCS) supplied from the timing controller 150, and sequentially supplies the generated scan signals to the scan lines (S1 to Sn). Here, the scan driver 110 supplies the scan signals during a portion of the first horizontal period (1H), as shown in FIG. 4.

In more detail, one horizontal period (1H) is divided into a scan period and a data period in a first embodiment of the present invention. The scan driver 110 supplies scan signals to the scan line (S) during the scan period of the one horizontal period (1H). However, the scan driver 110 does not supply scan signals to the scan line (S) during the data period of the one horizontal period (1H). In addition, the scan driver 110 generates emission control signals in response to the scan driving control signals (SCS), and sequentially supplies the generated emission control signals to the emission control lines (E1 to En). Here, the emission control signals are supplied during at least two horizontal periods.

The data driver 120 generates data signals in response to the data driving control signal (DCS) supplied from the timing controller 150, and supplies the generated data signals to the output lines (O1 to Om/i). Here, the data driver 120 sequentially supplies at least the number i ("i" represents an integer greater than 2) of the data signals to each of the output lines (O1 to Om/i) during the one horizontal period (1H), as shown in FIG. 4.

In more detail, the data driver 120 sequentially supplies the number i of data signals (R,G,B), which are later supplied to actual pixels, during the data period of the one horizontal period (1H). Here, supply periods of the data signals (R,G,B) and the scan signals, which are later supplied to the pixels, are not overlapped with each other since the data signals (R,G,B) which are later supplied to the pixels are supplied only during the data period. Also, in one embodiment, the data driver 120 supplies a dummy data (DD), which does not contribute to luminance, during the scan period of the one horizontal period (1H). Here, in another embodiment, the dummy data (DD) is not supplied since it does not contributes to luminance.

The timing controller 150 generates data driving control signals (DCS) and scan driving control signals (SCS) to correspond to synchronizing signals supplied from an external source. The data driving control signals (DCS) generated in the timing controller 150 are supplied to the data driver 120, and the scan driving control signals (SCS) are supplied to the scan driver 110.

The demultiplexer block unit 160 includes the number m/i of demultiplexers 162. That is, the demultiplexer block unit 160 has the same number of the demultiplexers 162 as that of the output lines (O1 to Om/i), and each of the demultiplexers 162 is connected to one of the output lines (O1 to Om/i). Also, each of the demultiplexers 162 is connected to the number i of the data lines (D). Such a demultiplexer 162 supplies the number i of data signals, supplied to the output lines (O), to the number i of the data lines (D) during the data period.

As described above, the number of the output lines (O) included in the data driver 120 can thus be reduced if the data signals supplied to the one output line (O) are supplied to the number i of the data lines (D). For example, if the number i is set to 3, then the number of the output lines (O) included in the data driver 120 is reduced to a third of the number in the device of FIG. 1, and therefore the number of data driving circuits included in the data driver 120 is also reduced. That is, the manufacturing cost may be lowered in an embodiment of the present invention by supplying the data signals, supplied to the one output line (O), to the number i of the data lines (D) using the demultiplexer 162.

The demultiplexer control unit 170 supplies the number i of control signals to each of the demultiplexers 162 during the data period of the one horizontal period (1H) so that the number i of the data signals supplied to the output lines (O) are divided into and supplied to the number i of the data lines (D). Here, the demultiplexer control unit 170 sequentially supplies the number i of the control signals to prevent the number i of the control signals, supplied during the data period, from being overlapped with each other, as shown in FIG. 4. Also, FIG. 2 shows that the demultiplexer control unit 170 is installed in the outside of the timing controller 150, but the present invention is not limited thereto. For example, the demultiplexer control unit 170 may be installed in the inside of the timing controller 150.

The data capacitors (Cdata) are disposed in every data line (D). Such a data capacitor (Cdata) temporarily stores the data signals supplied to the data lines (D), and supplies the stored data signals to the pixels 140. Here, the data capacitors (Cdata) use a parasitic capacitor that is equivalently formed in (or on) the data lines (D). Here, the parasitic capacitor equivalently formed in (or on) the data lines (D) may stably store the data signals since the parasitic capacitor has a larger capacitance than that of a storage capacitor formed in each of the pixels 140.

Figure 3:
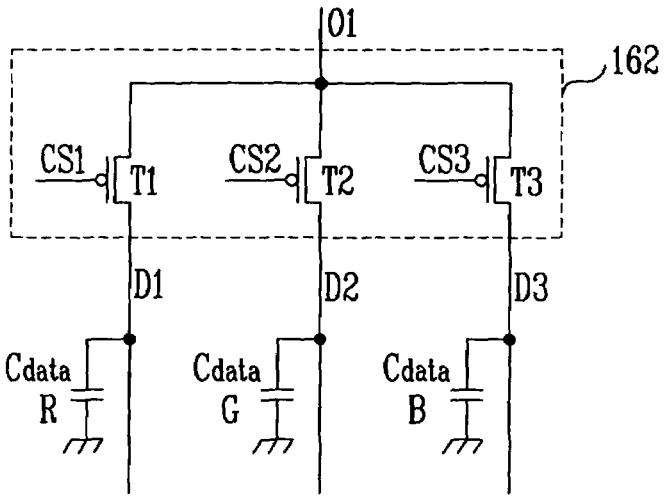
FIG. 3 is a circuit view showing a demultiplexer as shown in FIG. 2.

FIG. 3 is a circuit view of a demultiplexer as shown in FIG. 2. For convenience of description, it is assumed that the number i is set to 3 in FIG. 3. In addition, the demultiplexer 162 connected to the first output line (O1) is shown in FIG. 3.

Referring to FIG. 3, each of the demultiplexers 162 includes a first switching element (T1), a second switching element (T2), and a third switching element (T3).

The first switching element (T1) is connected between the first output line (O1) and the first data line (D1). Such a first switching element (T1) is turned on when the first control signal (CS1) is supplied from the demultiplexer control unit 170, to thereby supply the data signals, supplied to the first output line (O1), to the first data line (D1). The data signals supplied to the first data line (D1) are temporarily stored in the first data capacitor (CdataR) when the first control signal (CS1) is supplied from the demultiplexer control unit 170.

The second switching element (T2) is connected between the first output line (O1) and the second data line (D2). Such a second switching element (T2) is turned on when the second control signal (CS2) is supplied from the demultiplexer control unit 170, to thereby supply the data signals, supplied to the first output line (O1), to the second data line (D2). The data signals supplied to the second data line (D2) are temporarily stored in the second data capacitor (CdataG) when the second control signal (CS2) is supplied from the demultiplexer control unit 170.

The third switching element (T3) is connected between the first output line (O1) and the third data line (D3). Such a third switching element (T3) is turned on when the third control signal (CS3) is supplied from the demultiplexer control unit 170, to thereby supply the data signals, supplied to the first output line (O1), to the third data line (D3). The data signals supplied to the third data line (D3) are temporarily stored in the third data capacitor (CdataB) when the third control signal (CS3) is supplied from the demultiplexer control unit 170.

Figure 5:
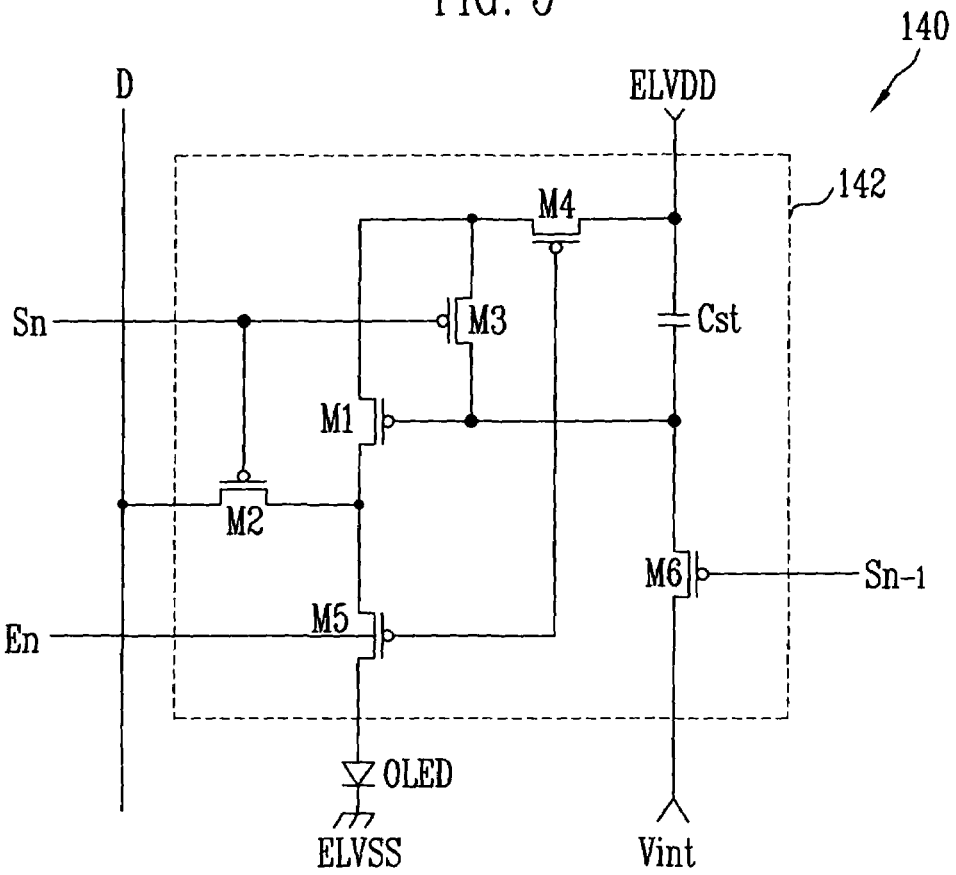
FIG. 5 is a circuit view showing a pixel adapted to be driven by the method according to the first embodiment.

FIG. 5 is a circuit view showing a configuration of a pixel adapted to be driven by a method according to a first embodiment of the present invention. The configuration of the pixel as shown in FIG. 5 is one example of the present invention, but the present invention is not limited thereto.

Referring to FIG. 5, each of the pixels 140 of the present embodiment includes an organic light emitting diode (OLED); and a pixel circuit 142 connected to the data line (D), the scan line (Sn), and the emission control line (En) to control the organic light emitting diode (OLED).

An anode electrode of the organic light emitting diode (OLED) is connected to the pixel circuit 142, and a cathode electrode is connected to a second power supply (ELVSS). The second power supply (ELVSS) is set to a lower voltage, for example, ground voltage, than that of the first power supply (ELVDD). The organic light emitting diode (OLED) generates light of red, green or blue color to correspond to a current capacity supplied from the pixel circuit 142.

The pixel circuit 142 includes a storage capacitor (Cst) and a sixth transistor (M6) connected between the first power supply (ELVDD) and the reset power supply (Vint); a fourth transistor (M4), a first transistor (M1), and a fifth transistor (M5) connected between the first power supply (ELVDD) and the organic light emitting diode (OLED); a third transistor (M3) connected between the gate electrode and the first electrode of the first transistor (M1); and a second transistor (M2) connected between the data line (D) and the second electrode of the first transistor (M1).

Here, the first electrode is set to be a drain electrode or a source electrode, and the second electrode is set to be the other one of the source and drain electrodes. For example, if the first electrode is set to be the source electrode, then the second electrode is set to be the drain electrode. Also, the first to sixth transistors (M1 to M6) are shown as P-type MOSFETs in FIG. 5, but the present invention is not limited thereto. However, polarity of a driving waveform is reversed if the first to sixth transistors (M1 to M6) are formed by N-type MOSFETs.

The first electrode of the first transistor (M1) is connected to the first power supply (ELVDD) via the fourth transistor (M4), and the second electrode of the first transistor (M1) is connected to the organic light emitting diode (OLED) via the fifth transistor (M5). Also, the gate electrode of the first transistor (M1) is connected to the storage capacitor (Cst). Such a first transistor (M1) supplies an electric current, corresponding to the voltage charged in the storage capacitor (Cst), to the organic light emitting diode (OLED).

The first electrode of the third transistor (M3) is connected to the first electrode of the first transistor (M1), and the second electrode of the third transistor (M3) is connected to the gate electrode of the first transistor (M1). Also, the gate electrode of the third transistor (M3) is connected to the $n^{th}$ scan line (Sn). Such a third transistor (M3) is turned on when the scan signals are supplied to the $n^{th}$ scan line (Sn), to thereby connect the first transistor (M1) in a diode mode. That is, the first transistor (M1) is connected in a diode mode when the third transistor (M3) is turned on.

The first electrode of the second transistor (M2) is connected to the data line (D), and the second electrode of the second transistor (M2) is connected to the second electrode of the first transistor (M1). Also, the gate electrode of the second transistor (M2) is connected to the $n^{th}$ scan line (Sn). Such a second transistor (M2) is turned on when the scan signals are supplied to the $n^{th}$ scan line (Sn), to thereby supply the data signals, supplied to the data lines (D), to the second electrode of the first transistor (M1).

The first electrode of the fourth transistor (M4) is connected to the first power supply (ELVDD), and the second electrode of the fourth transistor (M4) is connected to the first electrode of the first transistor (M1). Also, the gate electrode of the fourth transistor (M4) is connected to the emission control line (En). Such a fourth transistor (M4) is turned on when the emission control signals are not supplied (namely, when low emission control signals are supplied), to thereby electrically connect the first transistor (M1) with the first power supply (ELVDD).

The first electrode of the fifth transistor (M5) is connected to the first transistor (M1), and the second electrode of the fifth transistor (M5 is connected to the organic light emitting diode (OLED). Also, the gate electrode of the fifth transistor (M5) is connected to the emission control line (En). Such a fifth transistor (M5) is turned on when the emission control signals are not supplied (namely, when low emission control signals are supplied), to thereby electrically connect the organic light emitting diode (OLED) with the first transistor (M1).

The first electrode of the sixth transistor (M6) is connected to the storage capacitor (Cst) and the gate electrode of the first transistor (M1), and the second electrode of the sixth transistor (M6) is connected to the reset power supply (Vint). Also, the gate electrode of the sixth transistor (M6) is connected to the n−1$^{st}$ scan line (Sn−1). Such a sixth transistor (M6) is turned on when the scan signals are supplied to the n−1$^{st}$ scan line (Sn−1), to thereby reset the storage capacitor (Cst) and the gate electrode of the first transistor (M1). For this purpose, the reset power supply (Vint) is set to a lower voltage value than those of the data signals.

Figure 6:
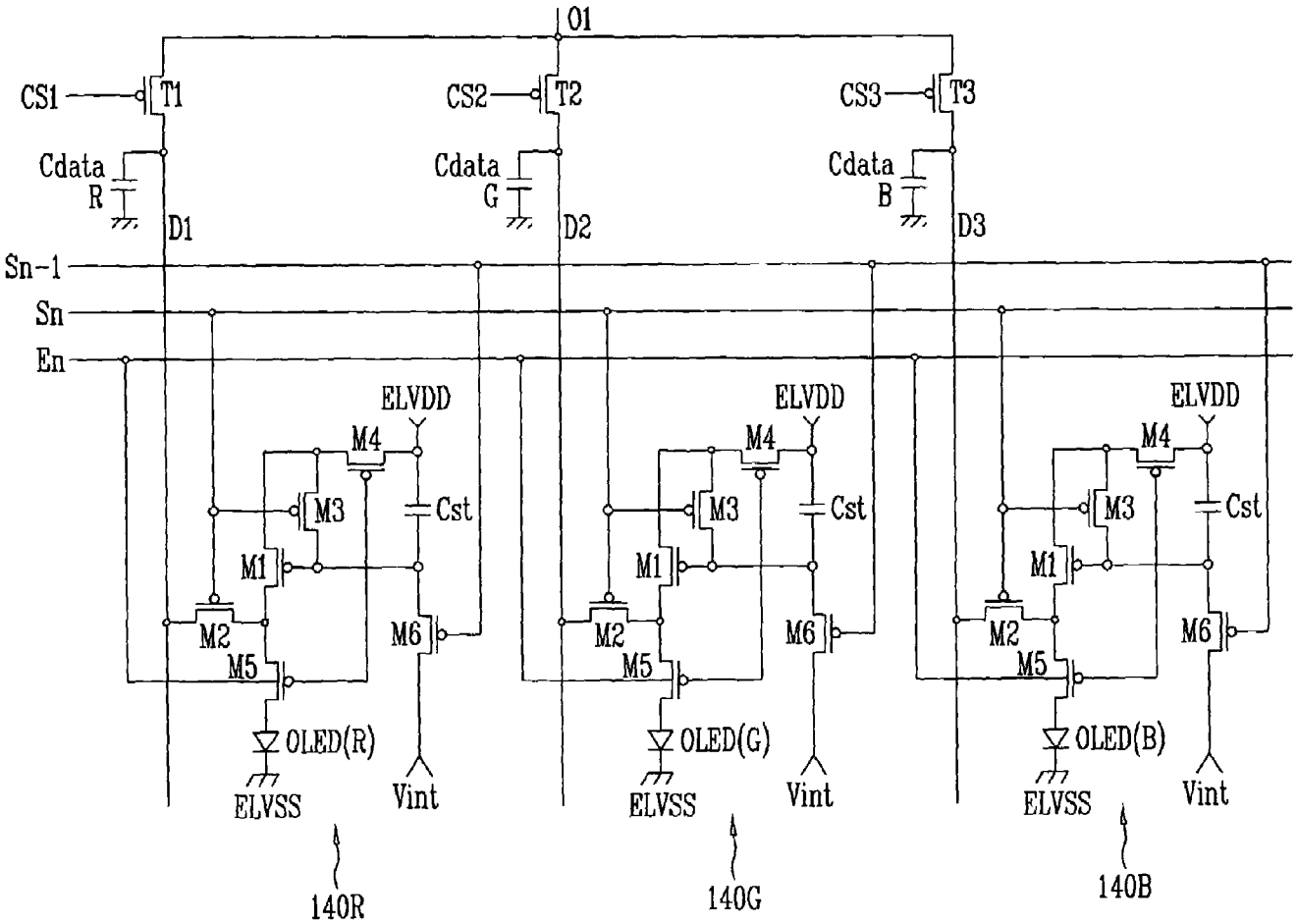
FIG. 6 is a cross-sectional view showing a configuration in which the demultiplexer is combined with the pixel as shown in FIG. 5.

FIG. 6 is a circuit view showing a detailed configuration in which the demultiplexer is combined with the pixel of FIG. 5.

In operation and referring to FIG. 4 and FIG. 6, scan signals are first supplied to the n−1$^{st}$ scan line (Sn−1) during the scan period of the one horizontal period (1H). If the scan signals are supplied to the n−1$^{st}$ scan line (Sn−1), then the sixth transistor (M6) included in each of the pixels 140R,140G, 140B is turned on. If the sixth transistor (M6) is turned on, then the storage capacitor (Cst) and the gate electrode (or gate terminal) of the first transistor (M1) is connected with the reset power supply (Vint). Then, the storage capacitor (Cst) and the gate electrode of the first transistor (M1) are reset to the voltage of the reset power supply (Vint).

Subsequently, the first switching element (T1), the second switching element (T2), and the third switching element (T3) are sequentially turned on by the first control signal (CS1) to the third control signal (CS3) sequentially supplied during the data period. If the first switching element (T1) is turned on, then a voltage corresponding to the data signals is charged in the first data capacitor (CdataR) formed in (or on) the first data line (D1). If the second switching element (T2) is turned on, then a voltage corresponding to the data signals is charged in the second data capacitor (CdataG) formed in (or on) the second data line (D2). If the third switching element (T3) is turned on, then a voltage corresponding to the data signals is charged in the third data capacitor (CdataB) formed in (or on) the third data line (D3). At this time, the data signals are not supplied to the pixels 140R,140G,140B since the second transistor (M2) included in each of the pixels 140R,140G, 140B is not set to a turned-on state.

Subsequently, scan signals are supplied to the n$^{th}$ scan line (Sn) during the scan period after the data period. If the scan signals are supplied to the n$^{th}$ scan line (Sn), then the second transistor (M2) and third transistor (M3) included in each of the pixels 140R,140G,140B are turned on. If the second transistor (M2) and third transistor (M3) included in each of the pixels 140R,140G,140B are turned on, then a voltage corresponding to the data signals, stored in the first data capacitor (CdataR) to the third data capacitor (CdataB), is supplied to the pixels 140R,140G,140B.

Here, the first transistor (M1) is turned on since the voltage of the gate electrode of the first transistor (M1) included in the pixels 140R,140G,140B is reset by the reset power supply (Vint) (namely, since the gate electrode of the first transistor (M1) is set to a lower voltage than those of the data signals). If the first transistor (M1) is turned on, then the data signals are supplied to one terminal of the storage capacitor (Cst) via the first transistor (M1) and the third transistor (M3). At this time, a voltage corresponding to the data signals is charged in the storage capacitor (Cst) included in each of the pixels 140R,140G,140B.

Here, in addition to the voltage corresponding to the data signals, a voltage corresponding to a threshold voltage of the first transistor (M1) is further charged in the storage capacitor (Cst). Subsequently, the fourth and fifth transistors (M4, M5) are turned on when the emission control signals are not supplied to the emission control signals (E) (namely, when low emission control signals are supplied to the emission control signals (E)), and therefore an electric current corresponding to the voltage charged in the storage capacitor (Cst) is applied to the organic light emitting diodes (OLED (R), OLED (G), OLED (B)), to thereby generate red, green, and blue lights having a certain (or predetermined) luminance.

That is, the present invention has an advantage in that the data signals supplied to one output line (O) are supplied to the number i of the data lines (D) using the demultiplexer 162. However, a sufficient charging time may not be ensured since the data signals are supplied to the storage capacitor (Cst) only during the scan period of the one horizontal period (1H) in the driving method according to the first embodiment of the present invention as shown in FIG. 4. In actuality, the present embodiment ensures a sufficient period when the control signals (CS) are supplied to ensure that a sufficient voltage is charged in the data capacitors (Cdata) during the data period. However, this may still result in shortening the charging time since the scan period may have to be shorter to ensure the sufficient period when the control signals (CS) are supplied.

Figure 7:
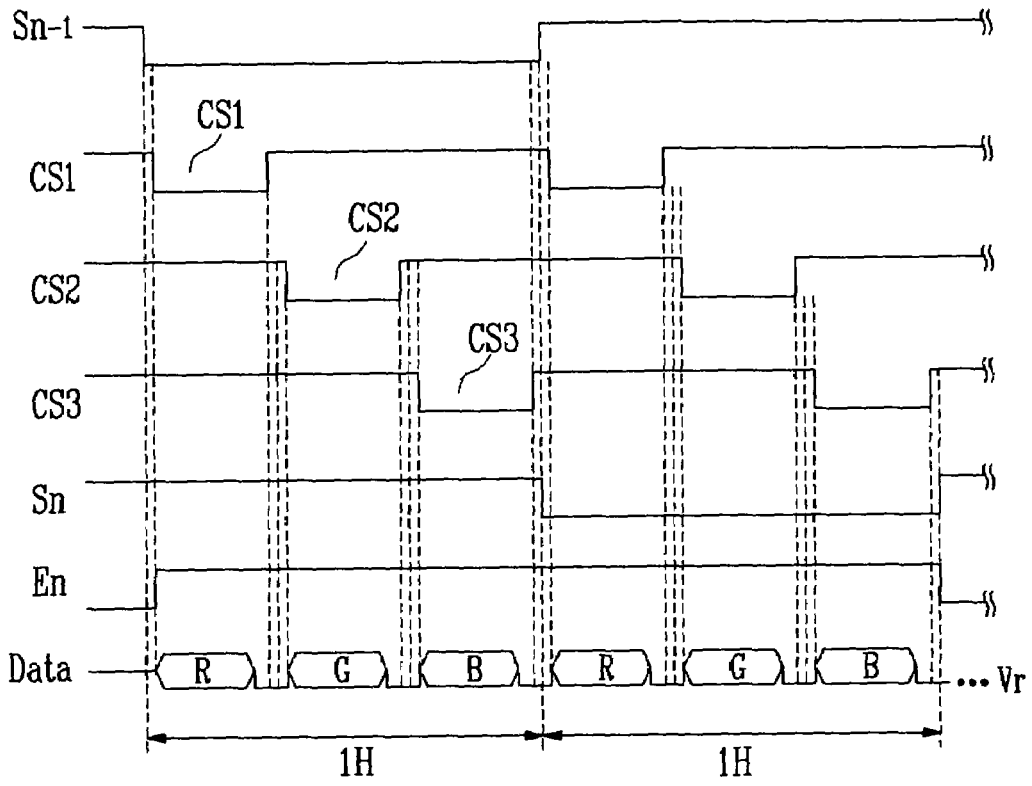
FIG. 7 is a waveform view showing a method for driving an organic light emitting display device according to a second embodiment of the present invention.

FIG. 7 is a waveform view showing a method for driving an organic light emitting display device according to a second embodiment of the present invention.

Referring to FIG. 7, in the method for driving this organic light emitting display device according to the second embodiment of the present invention, the scan driver 110 sequentially supplies scan signals during each horizontal period (1H). Also, the scan driver 110 supplies emission control signals so that the scan driver 110 can be overlapped with two scan signals.

The demultiplexer control unit 170 supplies the first control signal (CS1), the second control signal (CS2), and the third control signal (CS3) so that the demultiplexer control unit 170 can be overlapped with the scan signals during each horizontal period (1H). Here, the first control signal (CS1), the second control signal (CS2), and the third control signal (CS3) are sequentially supplied so that the first control signal (CS1), the second control signal (CS2), and the third control signal (CS3) are not overlapped with each other.

The data driver 120 sequentially supplies the number i of the data signals (R, G, B) to each of the output lines (O) during a period when the scan signals are supplied. Here, the data driver 120 supplies the reset voltage (Vr) among the data signals (R, G, B).

In more detail, the data driver 120 supplies the data signals (R, G, B) so that the data driver 120 can be overlapped with the control signals (CS1, CS2, CS3) when the control signals (CS1, CS2, CS3) are supplied. For example, the data driver 120 supplies the red data signal (R) so that the data driver 120 can be overlapped with the first control signal (CS1), and supplies the green data signal (G) so that the data driver 120 can be overlapped with the second control signal (CS2). Also, the data driver 120 supplies the blue data signal (B) so that the data driver 120 can be overlapped with the third control signal (CS3).

Also, the data driver 120 supplies the reset voltage (Vr) to the output lines (O) after each of the data signals (R, G, B) is supplied to the output lines (O). For example, the data driver 120 supplies the reset voltage (Vr) to the output lines (O) after the supply of the red data signals (R) is interrupted. Here, the reset voltage (Vr) is partially overlapped with the first control signal (CS1), and is continued to be supplied until the second control signal (CS2) is supplied. Also, the data driver 120 supplies the reset voltage (Vr) to the output lines (O) after the supply of the green data signals (G) is interrupted. Here, the reset voltage (Vr) is partially overlapped with the second control signal (CS2), and is continued to be supplied until the third control signal (CS3) is supplied. Also, the data driver 120 supplies the reset voltage (Vr) to the output lines (O) after the supply of the blue data signals (B) is interrupted.

Here, the reset voltage (Vr) is partially overlapped with the third control signal (CS3), and is continued to be supplied until the next first control signal (CS1) is supplied. Such a reset voltage (Vr) is used for resetting the voltage charged in the data capacitor (Cdata) (namely, a parasitic capacitor) included in each of the data lines (D). For this purpose, the reset voltage (Vr) is set to a lower voltage value than those of the data signals. That is, the reset voltage (Vr) is set to a lower voltage value than that of the lowest data signal that may be supplied to the data driver 120. For example, the reset voltage (Vr) may be set to the same voltage value as that of the reset power supply (Vint).

In operation and referring to FIG. 6 and FIG. 7, the pixels 140 connected to the $n-1^{st}$ scan line (Sn−1) and the $n^{th}$ scan line (Sn) are shown in FIG. 6.

In FIGS. 6 and 7, scan signals are first supplied to the $n-1^{st}$ scan line (Sn−1). If the scan signals are supplied to the $n-1^{st}$ scan line (Sn−1), then the sixth transistor (M6) included in each of the pixels 140R,140G,140B is turned on. If the sixth transistor (M6) is turned on, then one terminal of the storage capacitor (Cst) and the gate electrode of the first transistor (M1) are reset to have a voltage of the reset power supply (Vint).

In addition, the first control signal (CS1) to the third control signal (CS3) are sequentially supplied during a period when the scan signals are supplied to the $n-1^{st}$ scan line (Sn−1). Then, the first switching element (T1) to the third switching element (T3) are sequentially turned on, and simultaneously the data signals are supplied to the data lines (D1 to D3). In this case, the data signals are not supplied to the pixels 140R, 140G,140B connected to the $n^{th}$ scan line (Sn) since the scan signals are not supplied to the $n^{th}$ scan line (Sn), that is, since the second transistor (M2) is turned off.

Subsequently, the scan signals are supplied to the $n^{th}$ scan line (Sn) during the next horizontal period. If the scan signals are supplied to the $n^{th}$ scan line (Sn), then the second transistor (M2) and the third transistor (M3) included in each of the pixels 140R,140G,140B are turned on. Also, the first switching element (T1), the second switching element (T2), and the third switching element (T3) are sequentially turned on by the first control signal (CS1) to the third control signal (CS3) during a period when the scan signals are supplied to the $n^{th}$ scan line (Sn).

If the first switching element (T1) is turned on, then the red data signal (R) supplied to the first output line (O1) is supplied to the first data line (D1). The red data signal (R) supplied to the first data line (D1) is supplied to the pixel 140R via the second transistor (M2) of the red pixel 140R. In this case, the first transistor (M1) of the red pixel 140R is turned on since the gate electrode of the first transistor (M1) in the red pixel 140R is reset by the reset power supply (Vint). If the first transistor (M1) of the red pixel 140R is turned on, then the red data signal (R) is supplied to one terminal of the storage capacitor (Cst) via the first transistor (M1) and the third transistor (M3) of the red pixel 140R. At this time, voltages corresponding to the data signal and the threshold voltage of the first transistor (M1) are charged in the storage capacitor (Cst).

Subsequently, the reset voltage (Vr) is supplied to the first output line (O1) so that the reset voltage (Vr) can be overlapped with the first control signal (CS1) during some period. The reset voltage (Vr) supplied to the first output line (O1) changes a voltage of the parasitic capacitor (CdataR) (namely, the first data capacitor) of the first data line (D1) into a voltage of the reset voltage (Vr). In addition, although the parasitic capacitor (CdataR) of the first data line (D1) is changed to have the voltage of the reset voltage (Vr), a voltage charged in the red pixel 140R is maintained stably. That is, the voltage charged in the storage capacitor (Cst) is not supplied to the first data line (D1) again but maintained stably since the first transistor (M1) is connected in a diode mode.

If the second switching elements are turned on by the second control signal (CS2), then the green data signal (G) supplied to the first output line (O1) is supplied to the second data line (D2). The green data signal (G) supplied to the second data line (D2) is supplied to the green pixel 140G via the second transistor (M2) of the green pixel 140G. In this case, the first transistor (M1) of the green pixel 140G is turned on since the gate electrode of the first transistor (M1) in the green pixel 140G is reset by the reset power supply (Vint). If the first transistor (M1) of the green pixel 140G is turned on, then the green data signal (G) is supplied to one terminal of the storage capacitor (Cst) via the first transistor (M1) and the third transistor (M3) of the green pixel 140G. At this time, voltages corresponding to the data signals and the threshold voltage of the first transistor (M1) are charged in the storage capacitor (Cst).

Subsequently, the reset voltage (Vr) is supplied to the first output line (O1) so that the reset voltage (Vr) can be overlapped with the second control signal (CS2) during some period. The reset voltage (Vr) supplied to the first output line (O1) changes a voltage of the parasitic capacitor (CdataG) (namely, the second data capacitor) of the second data line (D2) into a voltage of the reset voltage (Vr). In addition, although the parasitic capacitor (CdataG) of the second data line (D2) is changed to have the voltage of the reset voltage (Vr), a voltage charged in the green pixel 140G is maintained stably. That is, the voltage charged in the storage capacitor (Cst) is not supplied to the second data line (D2) again but maintained stably since the first transistor (M1) is connected in a diode mode.

If the third switching element (T3) is turned on by the third control signal (CS3), then the blue data signal (B) supplied to the first output line (O1) is supplied to the third data line (D3). The blue data signal (B) supplied to the third data line (D3) is supplied to the blue pixel 140B via the second transistor (M2) of the blue pixel 140B. In this case, the first transistor (M1) of the blue pixel 140B is turned on since the gate electrode of the first transistor (M1) in the blue pixel 140B is reset by the reset power supply (Vint). If the first transistor (M1) of the blue pixel 140B is turned on, then the blue data signal (B) is supplied to one terminal of the storage capacitor (Cst) via the first transistor (M1) and the third transistor (M3) of the blue pixel 140B. At this time, voltages corresponding to the data signals and the threshold voltage of the first transistor (M1) are charged in the storage capacitor (Cst).

Subsequently, the reset voltage (Vr) is supplied to the first output line (O1) so that the reset voltage (Vr) can be overlapped with the third control signal (CS3) during some period. The reset voltage (Vr) supplied to the first output line (O1) changes a voltage of the parasitic capacitor (CdataB) (namely, the third data capacitor) of the third data line (D3) into a voltage of the reset voltage (Vr). In addition, although the parasitic capacitor (CdataB) of the third data line (D3) is changed to have the voltage of the reset voltage (Vr), a voltage charged in the blue pixel 140B is maintained stably. That is, the voltage charged in the storage capacitor (Cst) is not supplied to the second data line (D2) again but maintained stably since the first transistor (M1) is connected in a diode mode.

As described above, the driving method according to the second embodiment of the present invention has an advantage in that the manufacturing cost may be lowered since the data signals supplied to one output line (O) may be supplied to the number i of the data lines (D). Also, in the present embodiment, the scan signals are supplied during one horizontal period and the control signals (CS1, CS2, CS3) are sequentially supplied during a period when the scan signals are supplied. Also, a charging time of the data signals may be improved by supplying the desired data signals during a period when the control signals are supplied, and therefore a sufficient charging time of the pixels 140 may be ensured.

In the present embodiment, the reset voltage (Vr) supplied to the output lines (O) may allow the pixels to be driven stably. For this detailed description, the second transistor (M2) included in each of the pixels 140R,140G,140B is turned on during a period when the scan signals are supplied. Here, if the data lines (D1 to D3) are not reset by the reset voltage (Vr), then pixel voltages of the green pixel 140G and the blue pixel 140B are changed during a period when the first switching element (T1) is turned on since the first control signal (CS1) is supplied to the green pixel 140G and the blue pixel 140B. That is, a voltage of the previous data signal, which is charged in the third data capacitor (CdataB) via the second transistor (M2) of the blue pixel 140B, is supplied to the blue pixel 140B during a period when the first control signal (CS1) is supplied. As a result, the pixels are not driven stably since the voltage reset by the reset power supply (Vint) is changed into the voltage of the previous data signal. For example, although the third control signal (CS3) is supplied to turn on the third switching element (T3), a voltage of the blue pixel 140B may be undesirably maintained at a voltage level of the previous data signal.

Accordingly, a desired voltage may be allowed to be charged in the pixels 140 by supplying the reset voltage (or signal) (Vr) so that the reset signal (Vr) can be overlapped with control signals (CS1, CS2, CS3) during some period in the present invention. However, since the pixels 140 are additionally connected to wires connected to the reset power supply (Vint), the structure of the pixels 140 of the present embodiment as shown in FIG. 5 has an additional complexity. To reduce the complexity, another pixel adapted to be driven by the method according to the second embodiment of the present invention is shown in FIG. 8.

Figure 8:
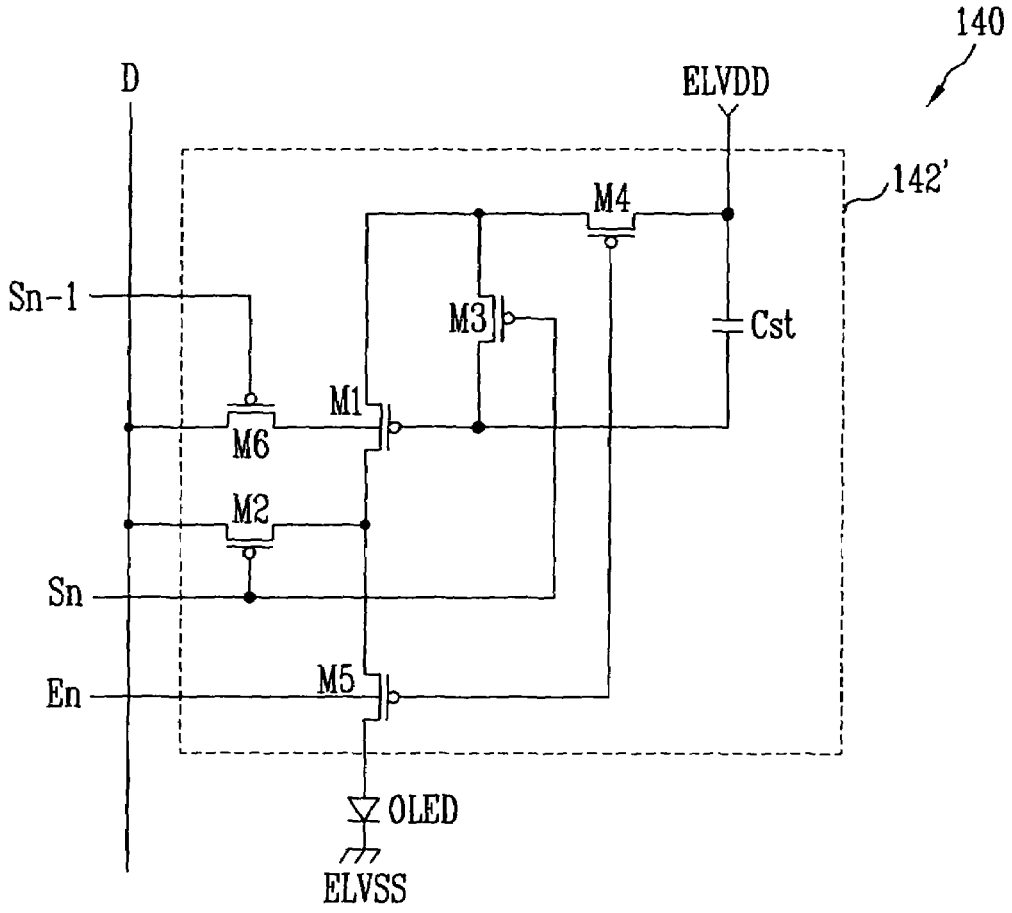
FIG. 8 is a circuit view showing a pixel adapted to be driven by the method according to the second embodiment.

FIG. 8 is a circuit view showing the another pixel adapted to be driven by the method according to the second embodiment of the present invention. For convenience of description, pixels connected to the $n-1^{st}$ scan line (Sn−1) and the $n^{th}$ scan line (Sn) are shown in FIG. 8.

Referring to FIG. 8, the pixels 140 include an organic light emitting diode (OLED), and a pixel circuit 142' connected to the data line (D), the scan lines (Sn−1, Sn), and the emission control line (En) to control the organic light emitting diode (OLED).

An anode electrode of the organic light emitting diode (OLED) is connected to the pixel circuit 142', and a cathode electrode is connected to a second power supply (ELVSS). The second power supply (ELVSS) is set to a lower voltage, for example, ground voltage, than that of the first power supply (ELVDD). The organic light emitting diode (OLED) generates light of red, green, or blue color to correspond to a current capacity supplied from the pixel circuit 142'.

The pixel circuit 142' includes a first transistor (M1), a second transistor (M2), a third transistor (M3), a fourth transistor (M4), a fifth transistor (M5), a sixth transistor (M6), and a storage capacitor (Cst). Here, the first to sixth transistors (M1 to M6) are shown as P-type MOSFETs in FIG. 8, but the present invention is not limited thereto.

Here, the first electrode of the first transistor (M1) is connected to the first power supply (ELVDD) via the fourth transistor (M4), and the second electrode of the first transistor (M1) is connected to the organic light emitting diode (OLED) via the fifth transistor (M5). Also, the gate electrode of the first transistor (M1) is connected to one terminal of the storage capacitor (Cst). Such a first transistor (M1) supplies an electric current corresponding to the voltage, charged in the storage capacitor (Cst), to the organic light emitting diode (OLED).

The first electrode of the third transistor (M3) is connected to the first electrode of the first transistor (M1), and the second electrode of the third transistor (M3) is connected to the gate electrode of the first transistor (M1). Also, the gate electrode of the third transistor (M3) is connected to the $n^{th}$ scan line (Sn). Such a third transistor (M3) is turned on when the scan signals are supplied to the $n^{th}$ scan line (Sn), to thereby connect the first transistor (M1) in a diode mode.

The first electrode of the second transistor (M2) is connected to the data lines (D), and the second electrode of the second transistor (M2) is connected to the second electrode of the first transistor (M1). Also, the gate electrode of the second transistor (M2) is connected to the $n^{th}$ scan line (Sn). Such a second transistor (M2) is turned on when the scan signals are supplied to the $n^{th}$ scan line (Sn), to thereby supply the data signals, supplied to the data lines (D), to the second electrode of the first transistor (M1).

The first electrode of the fourth transistor (M4) is connected to the first power supply (ELVDD), and the second electrode of the fourth transistor (M4) is connected to the first electrode of the first transistor (M1). Also, the gate electrode of the fourth transistor (M4) is connected to the emission control line (En). Such a fourth transistor (M4) is turned on when the emission control signals are not supplied, to thereby electrically connect the first transistor (M1) with the first power supply (ELVDD).

The first electrode of the fifth transistor (M5) is connected to the second electrode of the first transistor (M1), and the second electrode of the fifth transistor (M5) is connected to the organic light emitting diode (OLED). Also, the gate electrode of the fifth transistor (M5) is connected to the emission control line (En). Such a fifth transistor (M5) is turned on when the emission control signals are not supplied, to thereby electrically connect the organic light emitting diode (OLED) with the first transistor (M1).

The first electrode of the sixth transistor (M6) is connected to the gate electrode of the first transistor (M1), and the second electrode of the sixth transistor (M6) is connected to the data line (D). Also, the gate electrode of the sixth transistor (M6) is connected to the $n-1^{st}$ scan line (Sn−1). Such a sixth transistor (M6) is turned on when the scan signals are supplied to the n−1st scan line (Sn−1), to thereby reset the gate electrode of the first transistor (M1) to the reset voltage (Vr).

Figure 9:
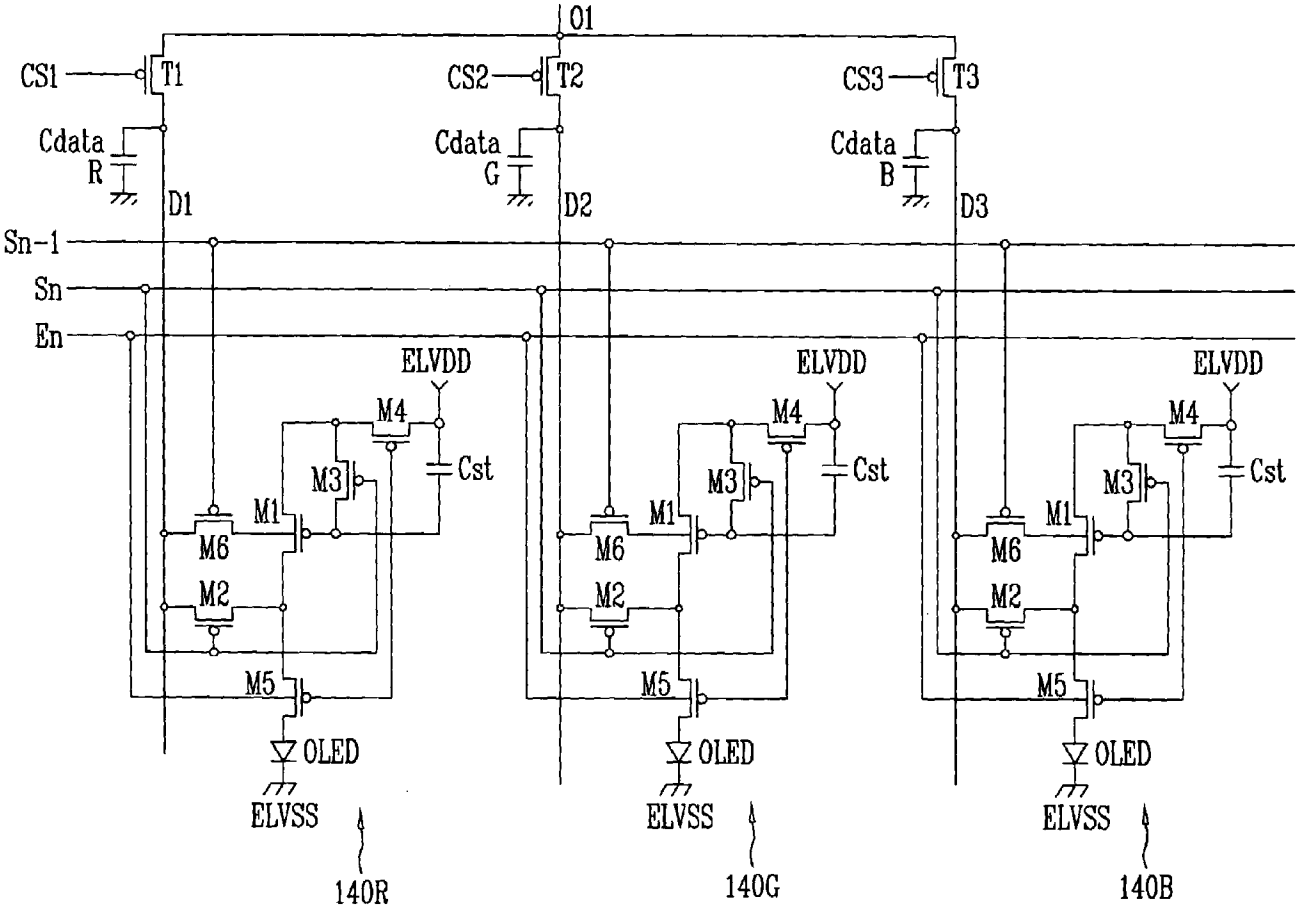
FIG. 9 is a cross-sectional view showing a configuration in which the demultiplexer is combined with the pixel as shown in FIG. 8.

FIG. 9 is a circuit view showing a configuration in which the demultiplexer is combined with the pixel of FIG. 8. Pixels connected to the n−1st scan line (Sn−1) and the nth scan line (Sn) are shown in FIG. 9.

In operation and referring to FIG. 7 and FIG. 9, scan signals are first supplied to the n−1st scan line (Sn−1) (the previous scan line), and simultaneously emission control signals are supplied to the nth emission control line (En). If the scan signals are supplied to the n−1st scan line (Sn−1), then the sixth transistor (M6) included in each of the pixels 140R, 140G,140B is turned on. Also, if the emission control signals are supplied to the nth emission control line (En), then the fourth transistor (M4) and the fifth transistor (M5) are turned off.

In addition, the first control signal (CS1), the second control signal (CS2), and the third control signal (CS3) are sequentially supplied during a period when the scan signals are supplied to the n−1st scan line (Sn−1). If the first control signal (CS1) is supplied to the first switching element (T1), then the first switching element (T1) is turned on to sequentially supply the red data signal (R) and the reset voltage (Vr). At this time, the gate electrode of the first transistor (M1) and the one terminal of the storage capacitor (Cst) are reset to the reset voltage (Vr) since the sixth transistor (M6) included in the red pixel 140R is set to a turned-on state. That is, the gate electrode of the first transistor (M1) and the one terminal of the storage capacitor (Cst), which are all included in the red pixel 140R, are changed to have the reset voltage (Vr) by the reset voltage (Vr) supplied after the red data signal (R).

In the same manner, a gate electrode of the first transistor (M1) and one terminal of the storage capacitor (Cst), which are all included in the green pixel 140G, are reset to the reset voltage (Vr) when the second control signal (CS2) is supplied. Also, a gate electrode of the first transistor (M1) and one terminal of the storage capacitor (Cst), which are all included in the blue pixel 140B, are reset to the reset voltage (Vr) when the third control signal (CS3) is supplied.

Subsequently, the scan signals are supplied to the nth scan line (Sn) (a current scan line). If the scan signals are supplied to the nth scan line (Sn), then the second transistor (M2) and the third transistor (M3) included in each of the pixels 140R, 140G,140B are turned on. Also, the first switching element (T1), the second switching element (T2), and the third switching element (T3) are sequentially turned on by the first control signal (CS1) to the third control signal (CS3) during a period when the scan signals are supplied to the nth scan line (Sn).

If the first switching element (T1) is turned on, then the red data signal (R) supplied to the first output line (O1) is supplied to the first data line (D1). The red data signal (R) supplied to the first data line (D1) is supplied to the red pixel 140R via the second transistor (M2) of the red pixel 140R. In this case, the first transistor (M1) of the red pixel 140R is turned on since the gate electrode of the first transistor (M1) in the red pixel 140R is reset to the reset voltage (Vr). If the first transistor (M1) of the red pixel 140R is turned on, then the red data signal (R) is supplied to one terminal of the storage capacitor (Cst) via the first transistor (M1) and the third transistor (M3) of the red pixel 140R. At this time, voltages corresponding to the data signal and the threshold voltage of the first transistor (M1) are charged in the storage capacitor (Cst).

Subsequently, the reset voltage (Vr) is supplied to the first output line (O1) so that the reset voltage (Vr) can be overlapped with the first control signal (CS1) during some period. The reset voltage (Vr) supplied to the first output line (O1) changes a voltage of the parasitic capacitor (CdataR) of the first data line (D1) into the voltage of the reset voltage (Vr). Also, although the parasitic capacitor (CdataR) of the first data line (D1) is changed to have the voltage of the reset voltage (Vr), a voltage charged in the red pixel 140R is maintained stably. That is, the voltage charged in the storage capacitor (Cst) is not supplied to the first data line (D1) again but maintained stably since the first transistor (M1) is connected in a diode mode.

If the second switching element (T2) is turned on by the second control signal (CS2), then the green data signal (G) supplied to the first output line (O1) is supplied to the second data line (D2). The green data signal (G) supplied to the second data line (D2) is supplied to the green pixel 140G via the second transistor (M2) of the green pixel 140G. In this case, the first transistor (M1) of the green pixel 140G is turned on since the gate electrode of the first transistor (M1) in the green pixel 140G is reset by the reset voltage (Vr). If the first transistor (M1) of the green pixel 140G is turned on, then the green data signal (G) is supplied to one terminal of the storage capacitor (Cst) via the first transistor (M1) and the third transistor (M3) of the green pixel 140G. At this time, voltages corresponding to the data signals and the threshold voltage of the first transistor (M1) are charged in the storage capacitor (Cst).

Subsequently, the reset voltage (Vr) is supplied to the first output line (O1) so that reset voltage (Vr) can be overlapped with the second control signal (CS2) during some period. The reset voltage (Vr) supplied to the first output line (O1) changes a voltage of the parasitic capacitor (CdataG) of the second data line (D2) into a voltage of the reset voltage (Vr). Also, although the parasitic capacitor (CdataG) of the second data line (D2) is changed to have the voltage of the reset voltage (Vr), a voltage charged in the green pixel 140G is maintained stably. That is, the voltage charged in the storage capacitor (Cst) is not supplied to the second data line (D2) again but maintained stably since the first transistor (M1) is connected in a diode mode.

If the third switching element (T3) is turned on by the third control signal (CS3), then the blue data signal (B) supplied to the first output line (O1) is supplied to the third data line (D3). The blue data signal (B) supplied to the third data line (D3) is supplied to the blue pixel 140B via the second transistor (M2) of the blue pixel 140B. In this case, the first transistor (M1) of the blue pixel 140B is turned on since the gate electrode of the first transistor (M1) in the blue pixel 140B is reset by the reset voltage (Vr). If the first transistor (M1) of the blue pixel 140B is turned on, then the blue data signal (B) is supplied to one terminal of the storage capacitor (Cst) via the first transistor (M1) and the third transistor (M3) of the blue pixel 140B. At this time, voltages corresponding to the data signals and the threshold voltage of the first transistor (M1) are charged in the storage capacitor (Cst).

Subsequently, the reset voltage (Vr) is supplied to the output line (O1) so that the reset voltage (Vr) can be overlapped with the third control signal (CS3) during some period. The reset voltage (Vr) supplied to the first output line (O1) changes a voltage of the parasitic capacitor (CdataB) of the third data line (D3) to the reset voltage (Vr). Also, although the voltage of the parasitic capacitor (CdataB) of the third data line (D3) is changed to the reset voltage (Vr), the voltage charged in the blue pixel 140B is maintained stably. That is, the voltage charged in the storage capacitor (Cst) is maintained stably without being supplied to the second data line (D2) since the first transistor (M1) is connected in a diode mode.

As described above, an embodiment of the present invention can lower the manufacturing cost because the data signals supplied to one output line (O1) may be supplied to the number i of the data lines (D). Also, an embodiment of the present invention can increase (or improve) the supplying time of the data signals because the control signals (CS1, CS2, CS3) are supplied during a period when the scan signals are supplied, to thereby ensure a sufficient charging time of the pixels 140. Also, in an embodiment of the present invention, since a pixel can be reset by the reset voltages (Vr) supplied from the data lines (D) according to the second embodiment of the present invention, the reset power lines may be omitted from the pixel, to thereby improve an aperture ratio.

Also as described above, a pixel according to an embodiment of the present invention, an organic light emitting display device using the same, and a driving method thereof can reduce the manufacturing cost because data signals, supplied to one output line, are supplied to a plurality of data lines. In addition, a pixel according to an embodiment of the present invention, an organic light emitting display device using the same, and a driving method thereof can improve a charging time of the pixel by supplying and overlapping scan signals and control signals with each other because reset voltages are supplied after data signals are supplied. Moreover, a pixel according to an embodiment of the present invention, an organic light emitting display device using the same, and a driving method thereof can accomplish a simple structure of the pixel because the pixel is reset using a reset voltage without additional reset power lines.

While the invention has been described in connection with certain exemplary embodiments, it will be appreciated by those skilled in the art that the invention is not limited to the disclosed embodiments, but, on the contrary, is intended to cover various modifications included within the principles and spirit of the invention, the scope of which is defined in the claims and their equivalents.

What is claimed is:

1. A method for driving an organic light emitting display device with a plurality of data signals and a reset signal having a lower voltage than those of the data signals during a plurality of scan periods including a first scan period and a second scan period immediately subsequent to the first scan period, each of the scan periods comprising a plurality of data-then-reset periods including a first data-then-reset period, the method comprising:

supplying a first data signal of the data signals and then the reset signal from a data driver to an output line coupled between the data driver and a demultiplexer during the first data-then-reset period of the first scan period and concurrently with supplying a first control signal from a demultiplexer control unit to the demultiplexer, the supplying of the first control signal overlapping with the supplying of the first data signal and with the supplying of the reset signal;

supplying the first data signal and then the reset signal, supplied to the output line during the first data-then-reset period of the first scan period, to a first data line of a plurality of data lines through the demultiplexer coupled to the output line, as selected by the first control signal;

resetting a pixel corresponding to the second scan period, by the reset signal from the first data-then-reset period of the first scan period and supplied by the first data line;

supplying a second data signal of the data signals and then the reset signal from the data driver to the output line during the first data-then-reset period of the second scan period;

supplying the second data signal and then the reset signal, supplied to the output line during the first data-then-reset period of the second scan period, to the first data line through the demultiplexer;

charging a voltage corresponding to the second data signal in the pixel during the first data-then-reset period of the second scan period when a scan signal is supplied to a current scan line of the pixel; and allowing the pixel to emit light corresponding to the charged voltage.

2. The method for driving the organic light emitting display device according to claim 1 wherein, for each of the data lines, the reset signal is supplied after one of the data signals is supplied during one of the data-then-reset periods.

3. The method for driving the organic light emitting display device according to claim 2, wherein the first scan period comprises a first number of data-then-reset periods and the plurality of data lines comprises a second number of data lines, and wherein the first number is equal to the second number.

4. The method for driving the organic light emitting display device according to claim 1, wherein the pixel is reset by the reset signal during the first scan period when the scan signal is supplied to a previous scan line of the pixel, and is charged with the voltage corresponding to the second data signal supplied to the pixel by itself during the second scan period when the scan signal is supplied to the current scan line of the pixel.

5. The method for driving the organic light emitting display device according to claim 4, wherein the reset signal is set to a lower voltage level than a voltage of the second data signal.

6. The method for driving the organic light emitting display device according to claim 1, wherein the demultiplexer includes a plurality of switching elements between the output line and the data lines, and the switching elements are sequentially turned on during a scan period of the plurality of scan periods when the scan signal is supplied.

7. An organic light emitting display device comprising:

a plurality of scan lines including a previous scan line and a current scan line;

a scan driver for supplying a scan signal during each of a plurality of scan periods including a previous scan period and a current scan period immediately subsequent to the previous scan period, the scan signal being supplied to the previous scan line during the previous scan period and to the current scan line during the current scan period, each of the scan periods including a plurality of data-then-reset periods defined by a corresponding plurality of control signals;

a data driver for supplying, during every one of the data-then-reset periods, a corresponding data signal of a plurality of data signals and then a reset signal having a lower voltage than those of the data signals to an output line coupled to the data driver concurrently with a supplying of a corresponding one of the control signals, the supplying of the corresponding one of the control signals overlapping with the supplying of the corresponding data signal and then with the supplying of the reset signal;

a plurality of data lines coupled to the output line and configured to be selected by the corresponding plurality of control signals;

a demultiplexer coupled between the output line and the data lines and configured to supply both the corresponding data signal and then the reset signal to each of the data lines through the demultiplexer as selected by the corresponding one of the control signals;

a demultiplexer control unit for supplying the control signals to the demultiplexer; and a pixel connected to the previous scan line, the current scan line, and a first one of the data lines corresponding to a first one of the control signals, wherein the pixel is configured to be reset by the reset signal from the first one of the data lines during a first one of the data-then-reset periods of the previous scan period when the scan signal is supplied to the previous scan line and the first one of the control signals is supplied to the demultiplexer, and to be charged with a voltage corresponding to the corresponding data signal from the first one of the data lines during the first one of the data-then-reset periods of the current scan period when the scan signal is supplied to the current scan line and the first one of the control signals is supplied to the demultiplexer.

8. The organic light emitting display device according to claim 7, wherein each of the scan periods comprises a first number of data-then-reset periods and the plurality of data lines comprises a second number of data lines, and wherein the first number and the second number are equal.

9. The organic light emitting display device according to claim 7, wherein the demultiplexer includes a plurality of switching elements arranged between the output line and the data lines.

10. The organic light emitting display device according to claim 9, wherein the demultiplexer control unit is configured to sequentially supply the control signals to the demultiplexer to sequentially turn on the switching elements during a scan period of the plurality of scan periods when the scan signal is supplied.

11. The organic light emitting display device according to claim 7, wherein the pixel comprises:

an organic light emitting diode;

a storage capacitor for charging the voltage corresponding to the corresponding data signal;

a first transistor for supplying an electric current, corresponding to the voltage stored in the storage capacitor, to the organic light emitting diode;

a second transistor connected to the first one of the data lines, the current scan line, and a second electrode of the first transistor, the second transistor being adapted to turn on when the scan signal is supplied to the current scan line;

a third transistor connected between a first electrode and a gate electrode of the first transistor, and being adapted to turn on when the scan signal is supplied to the current scan line; and a fourth transistor connected between the gate electrode of the first transistor and the first one of the data lines, and being adapted to turn on when the scan signal is supplied to the previous scan line.

12. The organic light emitting display device according to claim 11, further comprising:

a fifth transistor connected between the first electrode of the first transistor and the storage capacitor; and a sixth transistor connected between the second electrode of the first transistor and the organic light emitting diode.

13. The organic light emitting display device according to claim 12, wherein the fifth transistor is connected to the gate electrode of the first transistor via the third transistor.

14. The organic light emitting display device according to claim 12, wherein the fifth transistor and the sixth transistor are adapted to turn off during a period when an emission control signal is supplied from the scan driver, and adapted to remain turned on during other periods except for the period when the emission control signal is supplied from the scan driver.

15. The organic light emitting display device according to claim 14, wherein the scan driver is configured to supply the emission control signal to overlap with the scan signal supplied to the previous scan line and the scan signal supplied to the current scan line.

* * * * *